United States Patent [19]

Marmon, Jr.

[11] 4,139,022

[45] Feb. 13, 1979

[54] ARTICLE FOR REDUCING THE FLOW OF WATER TO A SHOWER HEAD

[75] Inventor: John C. Marmon, Jr., Lake Park, Fla.

[73] Assignee: Water Save, Inc., Lake Worth, Fla.

[21] Appl. No.: 816,288

[22] Filed: Jul. 18, 1977

[51] Int. Cl.[2] ..... B05B 1/30

[52] U.S. Cl. ..... 138/44; 239/590.3; 239/570

[58] Field of Search ..... 239/553.3, 569–571, 239/590.3; 138/40, 44

[56] References Cited

U.S. PATENT DOCUMENTS

| | | | |
|---|---|---|---|
| 1,939,509 | 12/1933 | McClelland | 138/44 |
| 2,680,043 | 6/1954 | Campbell | 239/570 X |
| 3,999,714 | 12/1976 | Lang | 138/44 X |
| 4,013,230 | 3/1977 | Gondek | 239/590.3 X |

FOREIGN PATENT DOCUMENTS

| | | | |
|---|---|---|---|
| 60895 | 6/1926 | Sweden | 138/44 |

*Primary Examiner*—Robert W. Saifer
*Attorney, Agent, or Firm*—Malin and Haley

[57] ABSTRACT

An article which may be placed at a point between the water pipe inflow line and a shower head to reduce the inflow of water to the shower head. More particularily a disc shaped article having a hole in its center and being concaved inward from its outer circumference to the center hole. The size and shape of said article being such that it is adaptable to a multiplicity of different size and shape shower heads.

3 Claims, 6 Drawing Figures

ARTICLE FOR REDUCING THE FLOW OF WATER TO A SHOWER HEAD

BACKGROUND OF THE INVENTION

This invention relates to the field of plumbing articles and more particularly to gaskets used for restricting the flow of water to a shower head.

The shortage of water in many areas of the country and worldwide awareness of the need to conserve water has brought forth a variety of devices and articles used for conserving water. Since people use a great deal of water showering, any means of reducing the amount of water used by people during showers would greatly reduce water use. Flat discs having one or more holes in them have been placed between the water inflow line and the shower head to reduce the flow of water to the shower head. Such discs have been helpful in conserving water and they have been found to be practical useful articles when placed between inflow line and shower heads which are flat. However, the inflow line of many showers is fitted with a ball joint over which the shower head fits, said joint making it possible to maneuver the direction of the head and thus the water spraying from the head. Flat discs do not fit well between ball joints and shower heads and when the water is turned on the disc may flutter causing cavitation and the interruption of water flow to the shower head. The article presented herein fits securely between a multiplicity of different types and sizes of shower heads and pipe fittings thus allowing a continuous flow of water.

SUMMARY OF THE INVENTION

A disc shaped article having a hole in its center and being concaved inward on one surface and convexed outward on the opposite surface. The article is composed of a suitable, rigid non-corrosive, easily moldable material. The diameter of the disc is 0.715 inches; the diameter of the center hole is 0.153 inches; and the width of the disc is 0.360 inches. The material is preferably nylon or celcon or other synthetic material.

In order to use this article, the shower head is removed from the water supply line to which it is connected. The convexed surface of the disc is then placed against shower head at the point where the head connects to the water supply line. A tubular protuberance on the concaved surface assures the disc from becoming misaligned on the ball type shower as it fits slightly into the hole in the ball. The head is then connected back up to the supply line. The disc is now in position for use. When the water is turned on the flow to the shower head is restricted by the disc which only allows water to flow through its center hole without restricting movement of the head.

In accordance with the above described structure and operation it is the primary object of this invention to disclose an article which restricts the flow of water to a shower head.

Another object is provide an article which is adaptable to a multiplicity of different size and shape shower heads and joints to which the heads are connected.

Another object is to present such an article which is easy to install and extremely durable.

Still another object is to present such an article which can be easily and economically produced.

These together with other objects and advantages will become apparent to those skilled in the art upon reading the details of construction and operation as more fully set forth hereinafter, reference being had to the accompanying drawings forming a part hereof, wherein like numerals refer to like parts throughout.

DETAILED DESCRIPTION OF PREFERRED EMBODIMENTS OF THE INVENTION

Before the present invention is specifically described, it is to be understood that the invention is not limited to the particular structure here shown, as such articles may vary. It is also to be understood that the phraseology or terminology herein used is for purposes of description of a particular embodiment and not of limitation, as the scope of the present invention is denoted by the appended claims.

Figure 1:
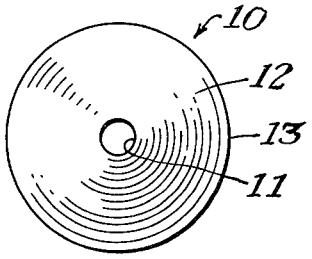
FIG. 1 is an illustration of a top view of the disc.
Figure 2:
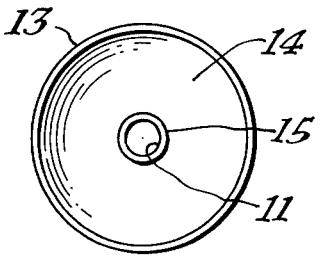
FIG. 2 is an illustration of a bottom view of the disc.
Figure 3:
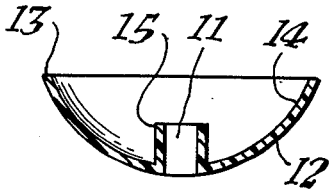
FIG. 3 is an illustration of a cross sectional side view of the disc.
Figure 6:
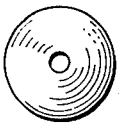
FIG. 6 is an illustration of a top view of an actual size disc for use in a shower head.

Referring now to the drawings and particularly to FIG. 1. The disc generally referred to by the number 10 is shown from an overhead view. The disc is circular and has a circular opening 11 at its center. This view illustrates that the top surface 12 of the disc is convexed outward from its edge 13 to the center hole 11. Referring now to FIG. 2, a bottom view of the disc 10 is shown. This view illustrates that the bottom surface 14 is concaved inward from the outer circumference 13 to a tubular protuberance 15 which surround the opening 11. FIG. 3 is a cross sectional side view of disc 10 showing center opening 11, top surface 12, edge 13, bottom surface 14 and the tubular protubuance 15 which surrounds the opening 11.

It has been found the the optimal and most practical size of the disc 10 is 0.710–0.720 inches in diameter with the center hole 11 being 0.150–0.155 inches in diameter and the height of the disc (shown in FIG. 3 by line H) is about 0.36 inches.

Figure 5:
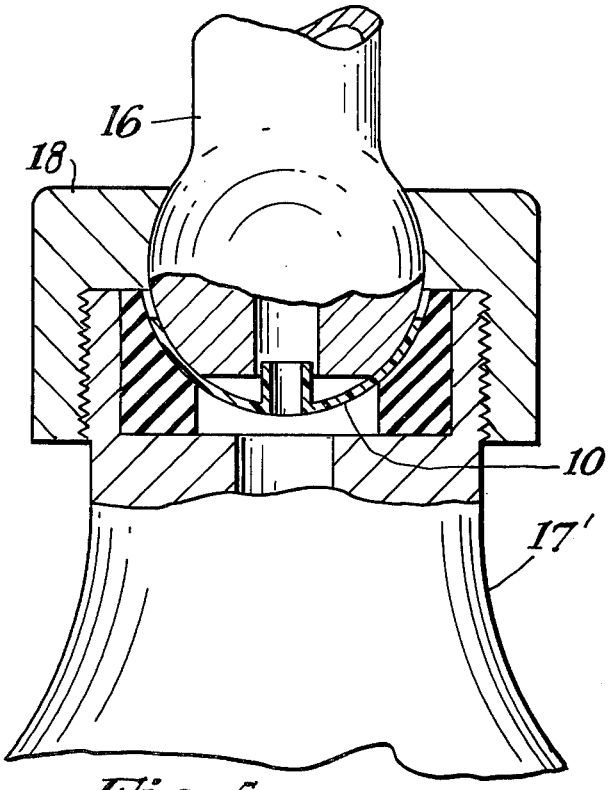
FIG. 5 shows the disc being placed between a ball joint connection and the shower head.
Figure 4:
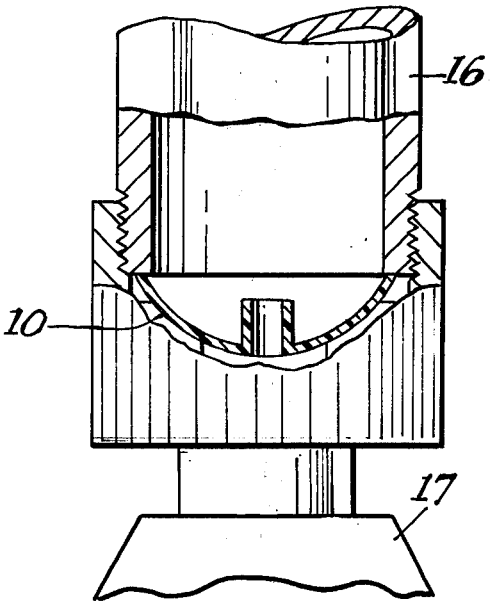
FIG. 4 shows the disc being placed between a flat ended water pipe and a shower head.

Referring now to FIGS. 4 and 5 in order to illustrate the installation and operation of this article. The inflow water line 16 is connectable directly to the shower head 17 or connectable to the shower head 17 via the ball joint connection 18. Either the old flat disc or the concaved disc presented herein could be used between the shower head and pipe shown in FIG. 4. However, the old flat type disc could not be used between ball joint 18 and the shower head shown in FIG. 5 because a flat disc will not fit against the ball shaped joint 18, thus when the water is turned on a flat disc will flutter causing cavitation and a non-continuous flow of water to the shower head.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An article for reducing the flow of water from a swiveling shower head comprising:

a single disc shaped shower head insertion piece having a circular opening in its center, said disc having one surface concaved inward from its outer circumference to said opening disposed adjacent the ball member of said swiveling shower head and a second surface convexed outward from the outer circumference to said opening disposed adjacent the socket member of said swiveling shower head, said opening having an annular raised ridge means circumscribed there about and extending from said inward concave surface for disposition within a water supply line to retain alignment of said circular opening with said water supply line when said shower head is swiveled about its longitudinal axis.

2. An article as in claim 1 wherein;

the diameter of said disc is between 0.60 inches to 0.90 inches and the diameter of said opening is 0.10 inches to 0.3 inches.

3. An article as in claim 2 wherein;

said disc is composed of a rigid, non-corrosive, easily moldable material.

* * * * *